US011613459B2

(12) United States Patent
Ritz

(10) Patent No.: US 11,613,459 B2
(45) Date of Patent: Mar. 28, 2023

(54) SADDLE PAD FOR A HORSE

(71) Applicant: Manuela Ahle, Hoppegarten (DE)

(72) Inventor: Peter Ritz, Hoppegarten (DE)

(73) Assignee: Manuela AHLE, Hoppegarten (DE)

( * ) Notice: Subject to any disclaimer, the term of this patent is extended or adjusted under 35 U.S.C. 154(b) by 0 days.

(21) Appl. No.: 17/283,945

(22) PCT Filed: Oct. 2, 2019

(86) PCT No.: PCT/EP2019/076692
§ 371 (c)(1),
(2) Date: Apr. 8, 2021

(87) PCT Pub. No.: WO2020/074341
PCT Pub. Date: Apr. 16, 2020

(65) Prior Publication Data

US 2021/0387850 A1 Dec. 16, 2021

(30) Foreign Application Priority Data

Oct. 9, 2018 (DE) ..... 10 2018 124 825.3

(51) Int. Cl.
*B68C 1/12* (2006.01)
*B68C 1/20* (2006.01)

(52) U.S. Cl.
CPC . *B68C 1/12* (2013.01); *B68C 1/20* (2013.01)

(58) Field of Classification Search
CPC .... B68C 1/02; B68C 1/00; B68C 1/12; B68C 1/20
USPC ..... 54/66
See application file for complete search history.

(56) References Cited

U.S. PATENT DOCUMENTS 115,772 A * 6/1871 Schmidt ..... B68C 1/025 54/66
809,276 A * 1/1906 Margaret ..... A61D 9/00 128/DIG. 20
4,136,506 A 1/1979 Miller
4,683,709 A 8/1987 Vasko et al.
(Continued)

FOREIGN PATENT DOCUMENTS

DE 134877 C 4/1901
DE 20 2005 005 377 U1 7/2005
(Continued)

OTHER PUBLICATIONS

German Office Action dated Jun. 11, 2019 as received in application No. 10 2018 124 825.3.

*Primary Examiner* — Brady W Frazier
*Assistant Examiner* — Zoe Tam Tran
(74) *Attorney, Agent, or Firm* — Maschoff Brennan

(57) ABSTRACT

The invention relates to a saddle pad for a horse, comprising at least one side part intended and adapted to extend on one side of a horse's back. The side part is further provided and adapted to be connected to a saddle comprising two saddle panels and two saddle flaps. Optionally, a sweat flap is arranged between the saddle pad and the saddle flap, respectively. It is provided that the side part has on its upper side at least one pocket which is provided and designed to accommodate, at least to some extent, one of the panels of the saddle or a portion of the saddle panel or to accommodate, at least to some extent, one of the saddle flaps or one of the sweat flaps or a portion of the saddle flap or sweat flap.

19 Claims, 9 Drawing Sheets

(56) References Cited

U.S. PATENT DOCUMENTS

| | | | | | |
|---|---|---|---|---|---|
| 6,125,616 | A * | 10/2000 | Brown | B68C 1/12 | 54/66 |
| 7,937,917 | B2 | 5/2011 | Mattes | | |
| 2003/0177742 | A1* | 9/2003 | Brownlie | B68C 1/08 | 54/66 |
| 2005/0086914 | A1* | 4/2005 | Fennelly | B68C 1/12 | 54/66 |
| 2006/0080946 | A1* | 4/2006 | DeCosemo | B68C 1/02 | 54/44.1 |
| 2015/0040523 | A1* | 2/2015 | Seggebruch | B68C 1/12 | 54/66 |
| 2015/0166325 | A1* | 6/2015 | Mattes | B68C 1/02 | 54/44.5 |

FOREIGN PATENT DOCUMENTS

| | | | | | |
|---|---|---|---|---|---|
| DE | 10 2010 035 616 | A1 | 3/2012 | | |
| DE | 20 2014 008 309 | U1 | 11/2014 | | |
| DE | 202014006159 | U1 * | 11/2014 | B68C 1/02 | |
| DE | 20 2015 001 072 | U1 | 3/2015 | | |
| EP | 0 078 657 | A2 | 5/1983 | | |
| EP | 1 752 414 | A1 | 2/2007 | | |
| EP | 1958919 | A1 * | 8/2008 | B68C 1/12 | |
| WO | 2004/050544 | | 6/2004 | | |

* cited by examiner

SADDLE PAD FOR A HORSE

REFERENCE TO RELATED APPLICATION

This application is a National Phase Patent Application of International Patent Application Number PCT/EP2019/076692, filed Oct. 2, 2019, which claims priority of German Patent Application No. 10 2018 124 825.3, filed on Oct. 9, 2018, the entire contents of both of which are incorporated herein by reference.

BACKGROUND

The invention relates to a saddle pad for a horse.

Saddle pads are positioned between the saddle and horse's back. Examples of saddle pads are saddle cloths, Western-saddle pads or shabraques. There is a need here to develop saddle pads further in order to provide optimum cushioning of the saddle in relation to the horse's back.

DE 10 2010 035 616 A1 discloses a saddle pad formed from a lower layer and an upper layer, which form a cover in which an interchangeable insert can be arranged.

DE 20 2005 005 377 U1 describes a pad for a horse which has a quilted layer on the upper side and can form a fleece layer on the underside.

The present invention is based on the object of providing an improved saddle pad.

SUMMARY

According to one aspect of the invention, the present invention provides a saddle pad having at least one side part, which is provided and designed to extend on one side of a horse's back. The side part is provided and designed to be connected to a saddle having two saddle panels and two saddle flaps. The saddle panels here, as seen in relation to the saddle positioned on a horse, are arranged in each case beneath the saddle flap and are provided to be laid on the horse's back or on the saddle pad. The saddle flap forms the outer side of the saddle, on which the rider's leg rests. Further elements of the saddle, for example a so-called sweat flap, can be arranged between the saddle panel and saddle flap.

According to aspects of the invention, on its upper side, the side part has at least one pocket, which is provided and designed to accommodate at least to some extent one of the panels of the saddle or a portion of the saddle panel. As an alternative, provision can be made for the pocket to be provided and designed to accommodate at least to some extent one of the saddle flaps or—if present—a sweat flap, arranged between the saddle panel and saddle flap, or a portion of the saddle flap or sweat flap.

According to aspects of the invention, therefore, part of the saddle, that is to say a saddle panel, a saddle flap or a sweat flap, is accommodated and retained at least to some extent in a pocket of the saddle pad. This is associated with the advantage that the saddle pad, that is to say the respective side part, is positioned optimally and on a lasting basis in relation to the saddle. The arrangement of a saddle panel, saddle flap or sweat flap in a pocket of the side part of the saddle pad reliably prevents the saddle pad and saddle from slipping relative to one another.

An example configuration here makes provision for the saddle pad to have two side parts, which extend on the two sides of the horse's back, wherein the two saddle panels or saddle flaps or sweat flaps are each positioned in a pocket of a side part of the saddle pad.

Provision can be made here for the saddle additionally to have a saddle tree as a stabilizing inner structure of the saddle, in which case the saddle panels are connected to the saddle tree. Instead of a saddle tree, however, it is also possible to use a saddle having a flexible frame made of leather or to use a treeless saddle. Saddle panels, which rest on the horse's back, are always present.

A variant of the invention makes provision for the side part to have a plurality of pockets, wherein each pocket accommodates only a portion of the saddle panel. Provision is therefore made, for example in the case of panels of dressage saddles, all-purpose saddles and jump saddles, for the saddle panels to have two spaced-apart ends oriented in different directions. In such a case, provision can be made for each of these ends to be fastened on the side part in a dedicated pocket.

As explained, the pocket can assume a large number of geometries. One configuration makes provision for the pocket to be elongate and to be designed to accommodate merely the lower portion of the saddle panel.

For fastening on a saddle, a variant makes provision for the side part to have corresponding fastening means. Such fastening means are formed, for example, by one or more straps or a tab, which are guided around a saddle part and then fastened on the side part, for example via a hook-and-loop fastening. It is also possible to provide a triangular fastening element which, once guided around a side part, can have a longitudinal side fastened on an edge of the side part for example via a hook-and-loop fastening on the side part.

A variant makes provision for the pocket to be positioned on, or sewn to, the upper side of the side part. Provision can be made here for the pocket to have a first edge, which is connected to the upper side, and a second edge, which forms the opening of the pocket. Provision can be made here for the first edge to be matched to the shape of an accommodated saddle panel or saddle-panel portion or saddle flap or sweat flap. Variants in this respect can provide for the first edge and the second edge to run horizontally, the first edge being the lower edge, or for the two edges to run obliquely in relation to one another or vertically in relation to one another. A variant makes provision for the lower edge to be of undulating design. The upper edge is, for example, rectilinear and—as seen in relation to the saddle pad fastened on the saddle—runs essentially horizontally.

This variant provides just an additional material layer to form the pocket, since the pocket extends between the side part and the additional material layer.

An alternative configuration for fitting the pockets on the side part makes provision for the pocket to be connected in a movable or pivotable manner to the upper side of the side part. For this purpose, provision is made, for example, for the pocket to be connected to the upper side of the side part exclusively along an upper edge. The pocket here is pivotable around this upper edge connected to the pocket. Provision is typically made here for a further upper edge to run parallel to the upper edge connected to the side part and for the opening of the pocket to be provided between these two upper edges.

In this variant, the pocket is double-layered, the pocket extending between the two layers. Just one material layer would be insufficient since, in this variant, the pocket does not butt against the side part.

A further alternative configuration for fitting the pocket on the side part makes provision for the pocket to be designed such that it can be removed from the upper side of the side part. For this purpose, provision is made, for example, so that, on the rear side, the pocket has a hook-and-loop-fastener strip, which can be connected to a hook-and-loop-fastener surface on the upper side of the side part to form a hook-and-loop fastening.

Provision can be made here to provide, on the upper side of the side part, a large-surface-area hook-and-loop-fastener surface, which is larger than the surface area taken up by the hook-and-loop-fastener strip. This makes it possible for the pocket to be fastened at different locations of the hook-and-loop-fastener surface, a hook-and-loop fastening with the upper side of the side part being formed in the process. As result, the pocket can be flexibly fastened on the side part at different positions, it therefore being possible for the pocket to be fastened in a suitable manner on the side part in dependence on the shape and orientation of the saddle panel.

It is also the case with this variant that the pocket is double-layered, since it is necessary to have a lower layer on which to fasten the hook-and-loop-fastener strip, via which the double-layered pocket is fastened on the side part.

A further configuration of the invention makes provision for the lower edge of the pocket to be essentially central, as seen in relation to the distance between the upper edge and lower edge of the side part. The pocket is therefore arranged essentially centrally on the two side parts of the saddle pad.

Provision can also be made for the lower edge and the upper edge to run essentially parallel. This is the case, in particular, when the lower edge of the saddle panel, which is accommodated by the pocket, is also essentially rectilinear.

A further variant makes provision for the side parts each to have a plurality of pockets, which are designed to accommodate in each case one portion of the saddle panel, wherein these portions of the saddle panel are separated spatially from one another.

The side parts of the saddle pad each have a main layer. Further layers can be provided in addition, in which case the saddle pad is multilayered. The aforementioned pocket is positioned on, or sewn to, for example the upper side of the main layer, wherein the aforementioned lower edge of the pocket is connected or sewn to the main layer.

An advantageous configuration makes provision for the saddle panel or saddle flap or sweat flap, which is arranged in the pocket, to be retained in the pocket, in addition, via fastening means. For this purpose, a variant makes provision for the fastening means to be in the form of at least two straps, which are fixed to the upper edge of the respective side part of the saddle pad and can be connected in a releasable manner to the pocket or some other portion of the side part. For this purpose, provision is made, in particular, for the straps to be positioned around the saddle panel or saddle flap or sweat flap and then connected to the upper surface of the pocket via a hook-and-loop connection. Accordingly, the upper surface of the pocket has a hook-and-loop surface, and a hook-and-loop surface is likewise formed at the ends of the straps.

An alternative variant makes provision for the fastening means to be formed by a tab, which is fixed to the upper edge of the side part and can be connected in a releasable manner to the pocket or some other portion of the side part. Such a tab is, for example, triangular, rectangular or trapezoidal, wherein a longitudinal side of the tab is fastened on the upper edge of the side part. Once positioned around the saddle panel or saddle flap or sweat flap, the tab is fastened on the upper surface of the pocket or at some other location of the side part, for example via a hook-and-loop connection.

On the one hand, the fastening means are used to secure the saddle panel or saddle flap or sweat flap in the pocket. On the other hand, the fastening means are used to fasten the side parts of the saddle pad on the saddle.

A further configuration of the invention makes provision so that, at least in some regions, the side parts of the saddle pad have an upper layer and a lower layer, between which are formed one or more chambers, into which correction pads can be introduced in each case. Such correction pads serve to provide for optimum seating of the saddle, in particular of the saddle panels, on the horse's back. The correction pads are formed, for example, from felt or as gel pads or as a rubber element, water chamber or oil chamber.

Provision is advantageously made here for it to be possible for the chambers to be filled in each case with at least one correction pad from the side edge and/or from the underside of the side part. This is associated with the advantage that correction pads can also be added or removed once the saddle is already resting on the horse's back.

In order for it to be possible to fill the respective chamber with a correction pad, the chambers have an openable and recloseable edge boundary, which is formed for example by a hook-and-loop fastening, a zipper or snap fasteners.

One configuration makes provision for the side parts to have one to twenty chambers for accommodating at least one correction pad. Provision can be made here for one or more chambers for accommodating a correction pad to be formed in the region of the front edge and/or in the region of the rear edge of the side part.

The underside of the side parts can be provided with a fleece or can be formed by one such. In particular, provision is made for the aforementioned chambers for accommodating correction pads to be formed on the underside of the side parts of the saddle pad in a region which has a fleece layer.

One configuration of the saddle pad makes provision for the saddle pad to have two side parts, wherein a first side part is provided and designed to extend on the one side of a horse's back, and a second side part is provided and designed to extend on the other side of the horse's back. Provision can be made here for the two side parts to be formed separated from one another. As an alternative, the two side parts are connected to one another or formed in one piece.

According to a second aspect of the invention, the present invention provides a saddle cloth having a first side part and a second side part, which are provided to extend on the one side and the other side of a horse's back, the two side parts being designed according to the invention. Accordingly, provision is made here so that, on its upper side, each side part of the saddle pad has at least one pocket, which is provided and designed to accommodate at least to some extent a panel of the saddle or a portion of the saddle panel or to accommodate at least to some extent a saddle flap or—if present—a sweat flap or a portion of the saddle flap or sweat flap.

Provision is made here for the two side parts to be formed separated from one another, that is to say in two parts. Each side part has fastening means for fastening the side part on a saddle. By providing two separate side parts, this aspect of the invention allows particularly good and straightforward positioning of the two side parts, since the latter can be positioned independently of one another and fastening takes place directly on the saddle.

BRIEF DESCRIPTION OF THE DRAWINGS

The invention will be explained in more detail on the basis of exemplary embodiments with reference to the accompanying drawings in which.

DETAILED DESCRIPTION

Figure 1:
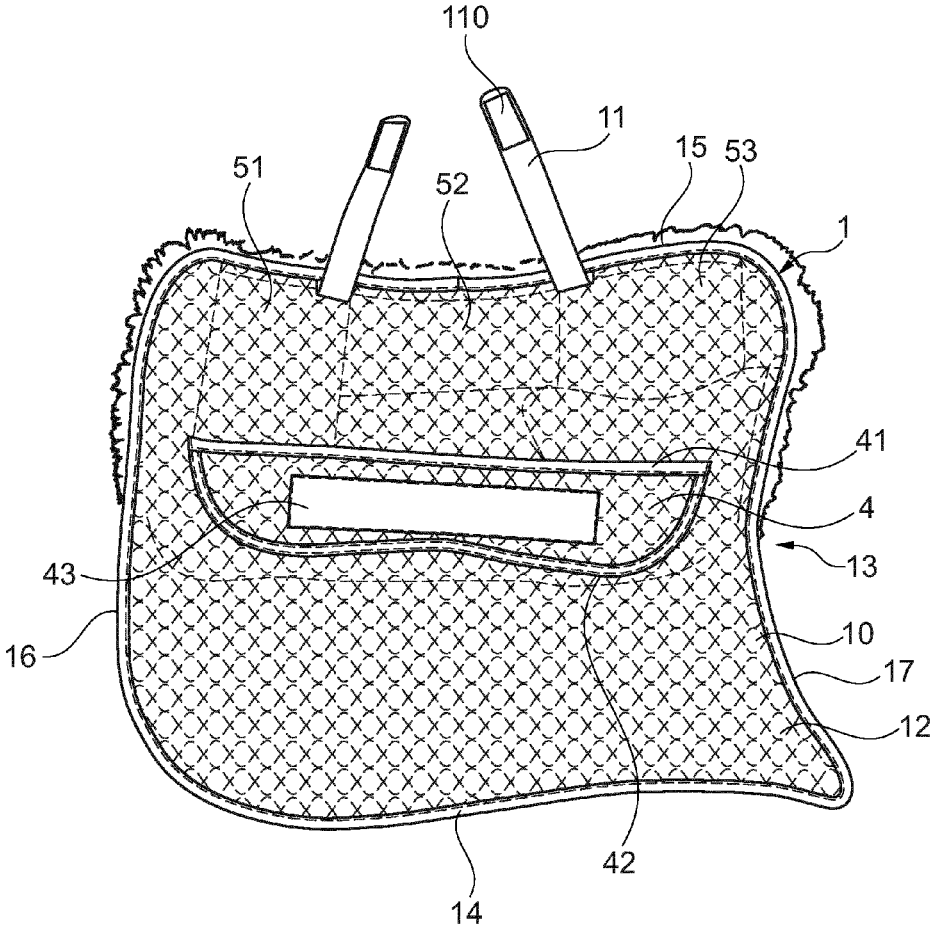
FIG. 1 shows a plan view of the upper side of the left-hand side part of a saddle pad according to the invention, wherein the side part has a pocket for accommodating a saddle panel, and wherein the side part comprises a plurality of chambers for accommodating correction pads.

FIG. 1 shows, in a view from above, the one side part 1 of a saddle pad comprising two separate side parts, which are not connected to one another directly. A connection is only indirect when the two side parts are connected to a saddle.

The side part 1 is designed to be arranged on the left-hand side of a horse's back. It has a main layer 10, which can be formed in principle from any desired material. For example, the main layer 10 is a quilted layer. The side part 1 comprises an upper side 12, an underside 13, a front edge 16, a rear edge 17, an upper edge 15 and a lower edge 14.

A pocket 4 is positioned on, or sewn to, the upper side 12 of the main layer 10 and said pocket has a lower edge 42, which is connected, for example sewn, to the main layer 10. An upper edge 41 is not connected to the main layer 10 and forms the pocket entrance. At the front and rear ends of the pocket 4, the lower edge 42 runs more or less perpendicularly and terminates at the upper edge 41.

An elongate fastening strip 43 in the form of a hook-and-loop strip is fitted on the pocket 4.

Two fastening straps 11 are arranged on the upper edge 15 of the side part 1, and these fastening straps have hook-and-loop surfaces 110 at their end which is directed away from the side part 1. The fastening straps 11 are spaced apart by a distance which corresponds essentially to the length of the fastening strip 43 of the pocket 4. Instead of fastening straps 11, it is also possible to use other fastening means, for example a fastening tab, which is triangular, rectangular or trapezoidal and has a longitudinal side fastened on the upper edge 15 of the side part 1.

It can be seen that in the exemplary embodiment illustrated, although not necessary, the lower edge 42 of the pocket 4 runs in a slightly undulating manner. The upper edge 41 is rectilinear. However, at least in the region of the fastening strip 43, the two edges 41, 42 run more or less parallel. It can also be seen that the lower edge 42 is arranged essentially centrally on the upper side 12 of the side part 1, i.e. the distances to the upper edge 15 and to the lower edge 14 of the side part 1 are essentially equal.

The side part 1 also has a plurality of chambers 51, 52, 53, of which each serve to accommodate one or more correction pads. Such correction pads are known in principle and serve to provide optimum cushioning for the saddle.

Figure 5:
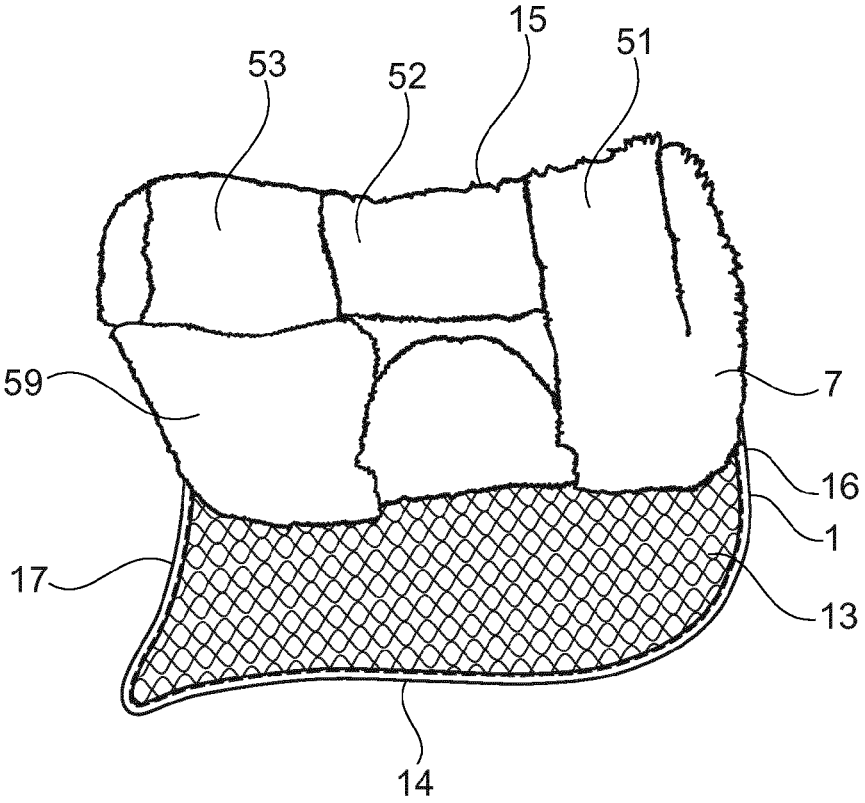
FIG. 5 shows a plan view of the underside of the side part from FIG. 1.

FIG. 5 shows the side part 1 in the view from beneath. It can be seen here that the side part 1 has a further material layer 7 adjacent to the upper edge 15. This material layer 7 is a fleece or a fleece layer. The main layer 10 and the fleece layer 7 are sewn to one another or connected to one another in some other way. The chambers 51, 52, 53, 59 are formed as a result. The chambers 51, 52, 53, 59 can be opened and closed again in each case along an edge portion, for example via a hook-and-loop fastening, a zipper or snap fasteners. This makes it possible for in each case one or more correction pads to be introduced into a chamber. For example, it is possible for the chamber 59 to be filled via the rear edge 17.

It is the case here that, rather than the correction pads 51-53 filling the chambers from the upper side 12 of the side part 1, they fill the same either from the edge or from the underside 13 of the side part 1. This makes it possible for correction pads to be introduced into, or removed from, a saddle even once the side part 1 has been fitted.

It is pointed out that the design of the side part 1 with two layers, that is to say a main layer 10 and a lower layer 7, which in the exemplary embodiment illustrated is formed by a fleece, should be understood only by way of example. For example, it is also possible for the side part 1 to have more than two layers or to comprise just one layer, in which case either the formation of chambers for correction pads is dispensed with or these chambers are formed by pockets sewn to the main layer. It is likewise possible for the lower layer 7 to be formed by a material other than a fleece. It is also the case that the extent of the lower layer 7 should be understood only by way of example. In other exemplary embodiments, the lower layer 7 extends to the lower edge 14 of the side part 1, in which case it is essentially congruent with the main layer 10.

The side part 1 illustrated has a further side part, which is provided and designed to be arranged on the right-hand side of the horse's back. The two side parts together form the saddle pad. The further side part is formed in a mirror-symmetrical manner in relation to the side part 1. A corresponding further side part 2 will be explained in relation to FIGS. 6 and 7, the latter illustrating a variant of the saddle pad from FIGS. 1 and 5 in which the chambers for accommodating correction pads are designed in a different manner.

The function of the pocket 4 will be discussed hereinbelow. The pocket first will accommodate a panel of the saddle, as a result of which the saddle panel and side part are positioned reliably in relation to one another. Before this is described in more detail with reference to FIGS. 2 and 4, a description will be given first of all, with reference to FIG. 3, of the basic construction of a saddle with which the saddle pad according to the invention interacts.

Figure 3:
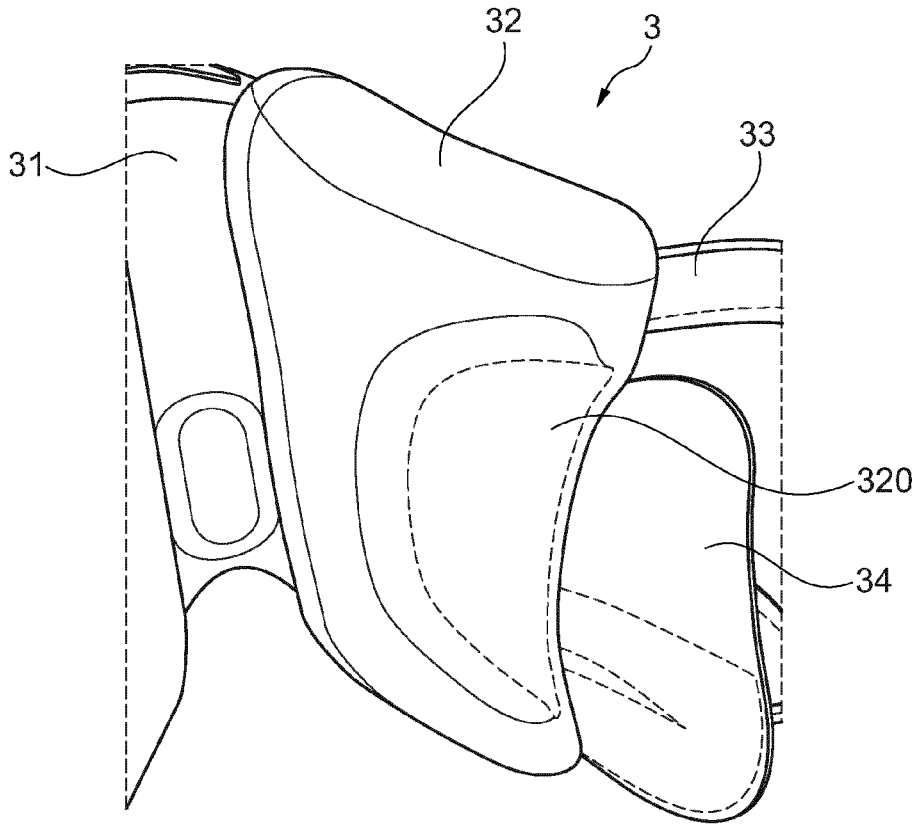
FIG. 3 shows, in a view from beneath, a saddle comprising a saddle tree, a saddle panel, a sweat flap and a saddle flap, only the one saddle half being evident in the view illustrated.

According to FIG. 3, a saddle has a saddle tree 31 as a load-bearing inner structure. As an alternative, it is also possible for the saddle to be treeless. The saddle tree 31 has attached to it, on either side, a saddle panel 32 and also a saddle flap 33. In the exemplary embodiment illustrated, although not necessary, a further material layer, which forms a so-called sweat flap 34, is located between the saddle panel 32 and saddle flap 33. The saddle flap 33 forms the outer surface of the saddle, on which the rider's thigh rests. The saddle panel 32 is located beneath the saddle flap 33 and is provided to be laid on the horse's back. It cushions the saddle tree 31, to a certain extent, and the saddle, as a whole, in relation to the horse's back.

In the side view, the saddle panel 32 is more or less rectangular. It is possible for it to be uniform or, as in the exemplary embodiment illustrated, structured in different regions and to have, for example, a region 320 which is of relatively flat design.

Along its upper edge, the saddle panel 32 is not connected continuously to the saddle tree 31. Rather, there is a gap between the upper edge of the saddle panel 32 and the saddle tree 31, it being possible for the fastening straps 11 to be inserted through said gap.

Figure 2:
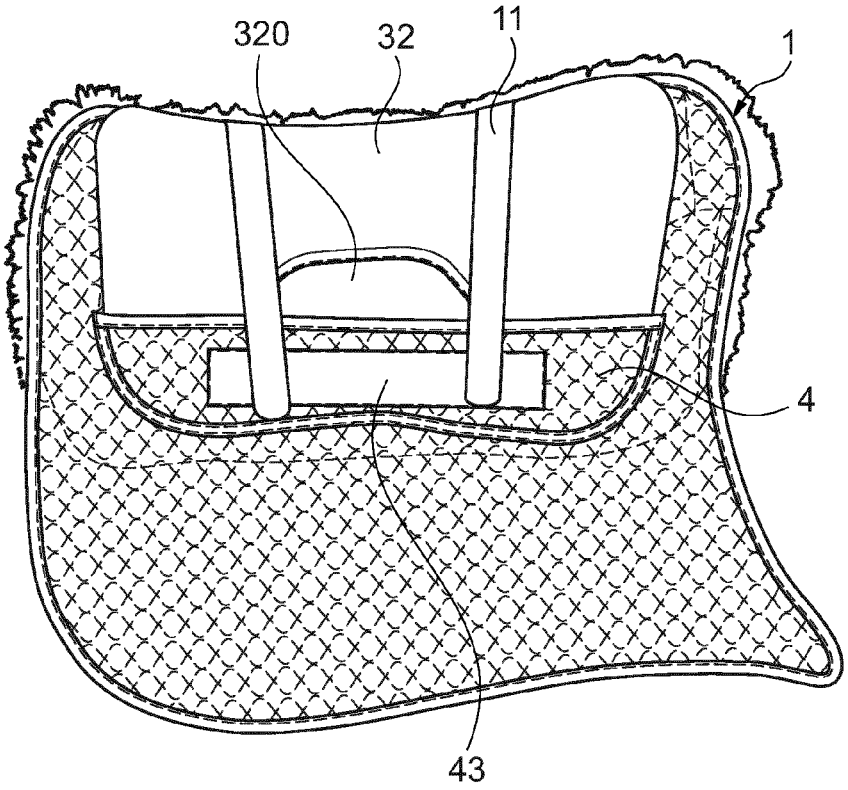
FIG. 2 shows the side part according to FIG. 1, wherein a saddle panel has been inserted into the pocket and fastened via fastening means.

FIG. 2 shows the saddle panel 32 once it has been inserted into the pocket 4. In addition, the side part 1 has been fixed to the saddle panel 32 via the fastening straps 11. For this purpose, the fastening straps 11 are guided around the saddle panel 32 and have their hook-and-loop surfaces 110 fastened on the fastening surface 43 of the pocket 4. It is pointed out here that, for reasons relating to clarity, FIG. 2 shows the saddle panel 32 without the saddle. In actual fact, the saddle panel is, of course, fastened on the saddle.

Figure 4:
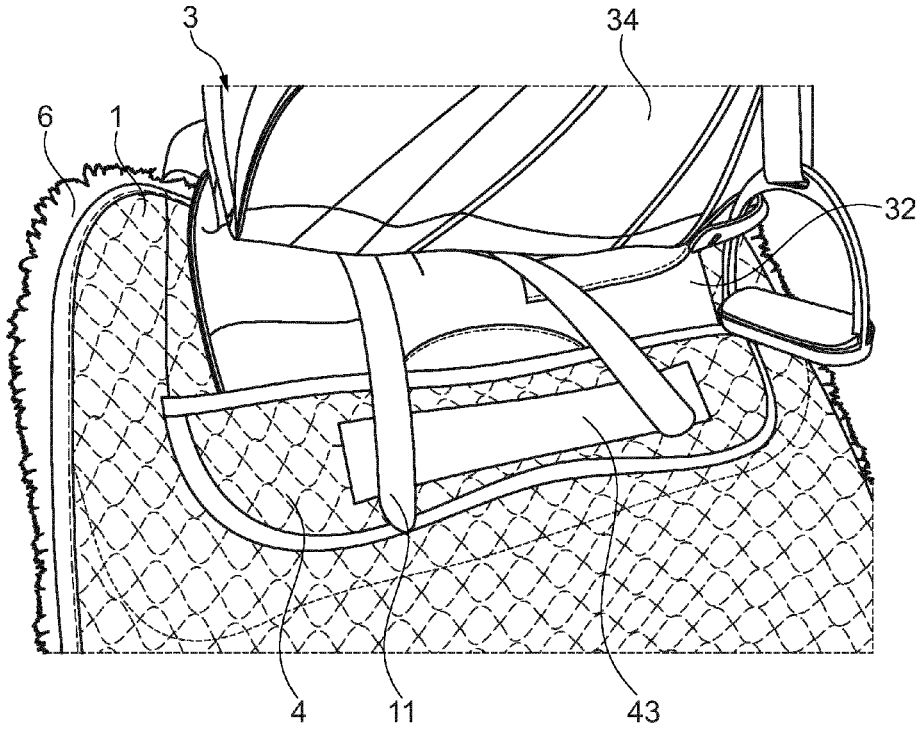
FIG. 4 shows the side part from FIG. 1 and a saddle, which has been laid on a horse's back, wherein a panel of the saddle has been inserted into the pocket of the side part.

A corresponding illustration is shown in FIG. 4. It is possible to see a horse 6, with the side part 1 of the saddle pad laid on its back, wherein a saddle 3 has likewise been laid on the horse's back and connected to the side part 1.

The saddle panel 32 here has been inserted into the associated pocket 4 of the side part 1. In addition, the fastening straps 11 have been inserted, from the upper edge 15 of the side part 1, through the gap between the saddle panel 32 and the saddle tree and guided downward on the front side of the saddle panel 32 and fastened on the fastening surface 43 of the pocket 4 via a hook-and-loop fastening. The sweat flap 34 has been raised up in FIG. 4, so that it is possible to see the components arranged therebeneath.

Figure 6:
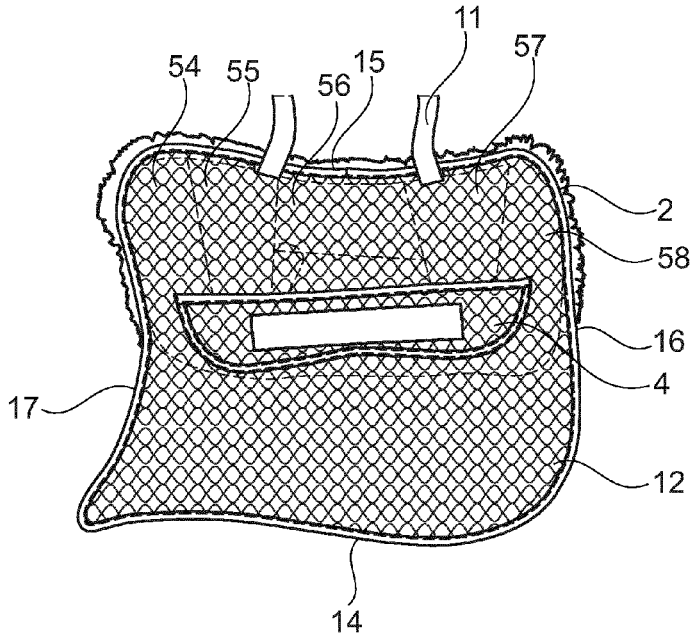
FIG. 6 shows a plan view of the upper side of the right-hand side part of a further exemplary embodiment of a saddle pad according to the invention, wherein the saddle pad differs from the saddle pad from FIGS. 1 to 5 in the arrangement of the chambers for accommodating correction pads.
Figure 7:
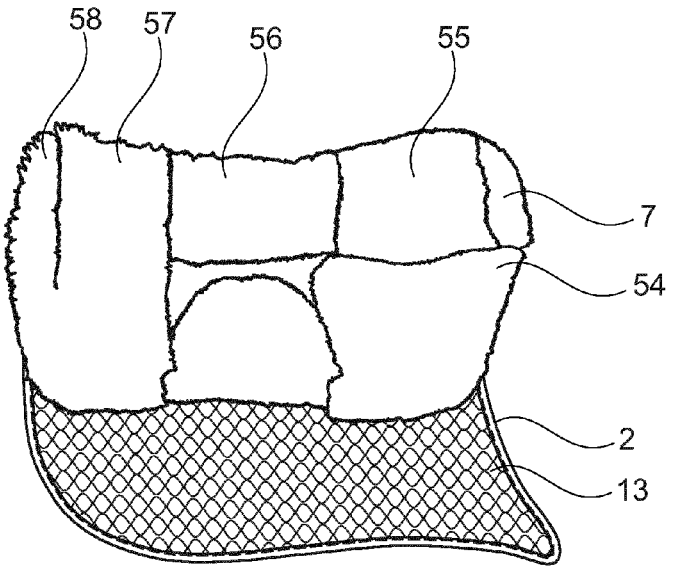
FIG. 7 shows a plan view of the underside of the side part from FIG. 6.

FIGS. 6 and 7 show, in a view from above and in a view from beneath, a further exemplary embodiment of a side part 2 of a saddle pad. The side part 2 illustrated here is one which is provided and designed to be arranged on the right-hand side of the horse's back. The basic construction is identical to that of the side part from FIGS. 1 to 5, and therefore reference is made to the relevant description.

The only difference is the design of the chambers which serve to accommodate correction pads. There are therefore five chambers 54-58 provided, wherein some of the chambers 54, 58 run along the side edge 16, 17 and can be filled from the side edge 16, 17. It is the case here that the boundary edge of the respective chamber, which can be opened and closed again in order for a correction pad to be introduced into the chamber and removed therefrom, coincides with the edge of the side part 2. For this purpose, for example a hook-and-loop fastening is formed on the boundary edge.

Figure 8:
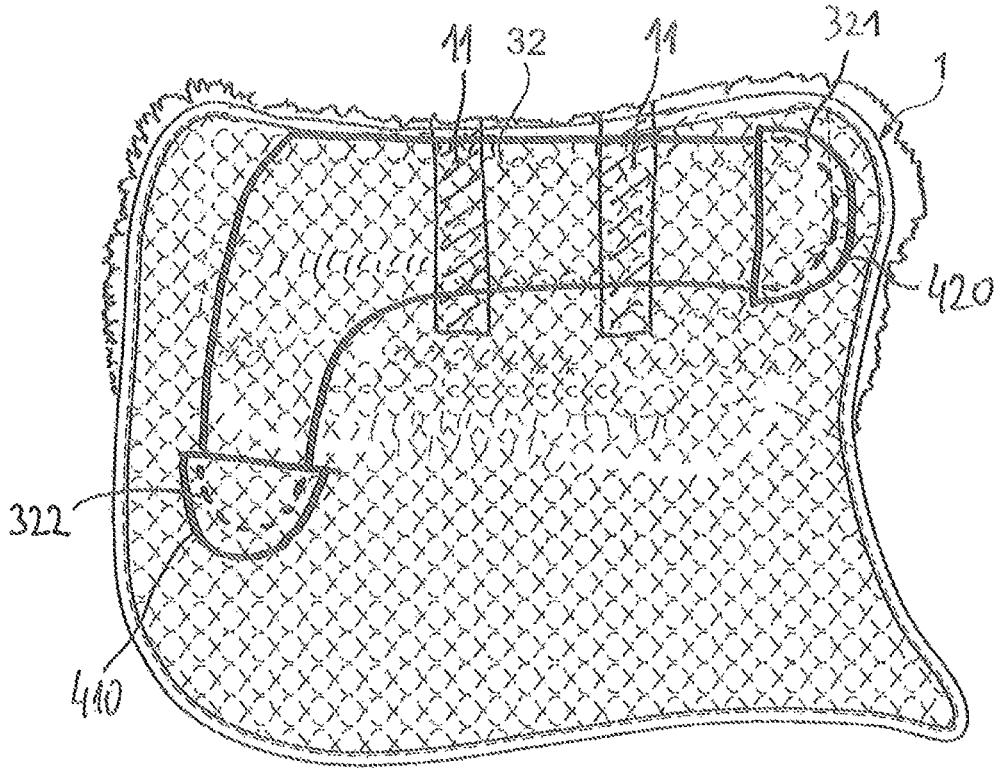
FIG. 8 shows a plan view of the upper side of the left-hand side part of a further exemplary embodiment of a saddle pad according to the invention, wherein the side part has two pockets for accommodating portions of the saddle panel in each case.

FIG. 8 shows, schematically, a further exemplary embodiment of a saddle pad according to the invention. This exemplary embodiment differs from the exemplary embodiments from FIGS. 1 to 7 in that the saddle pad 32 has a different shape and comprises portions 321, 322, which form ends of the saddle panel 32 which are at a distance from one another. So as to ensure, if the saddle panel 32 is shaped in such a way, that the saddle panel 32 is fastened securely on the side parts 1, 2 of the saddle pad, each side part 1, 2 has two pockets 410, 420, which accommodate the end of in each case one portion 321, 322 of the saddle panel 32. Depending on the shape of the saddle panel 32, it is also possible to provide more than two pockets. Provision can also be made to provide pockets which accommodate, and support, the side regions of the saddle panel. The orientation and shape of the pockets 410, 420 illustrated should be understood merely by way of example and, of course, in dependence on the shape and orientation of the portions of the saddle panel 32 which are accommodated by the pocket.

The saddle panel 32 from FIG. 8 is fastened on the side part 1 via two fastening straps 11 or, as an alternative, a fastening tab, for example via a hook-and-loop connection not illustrated in any detail.

Figure 9:
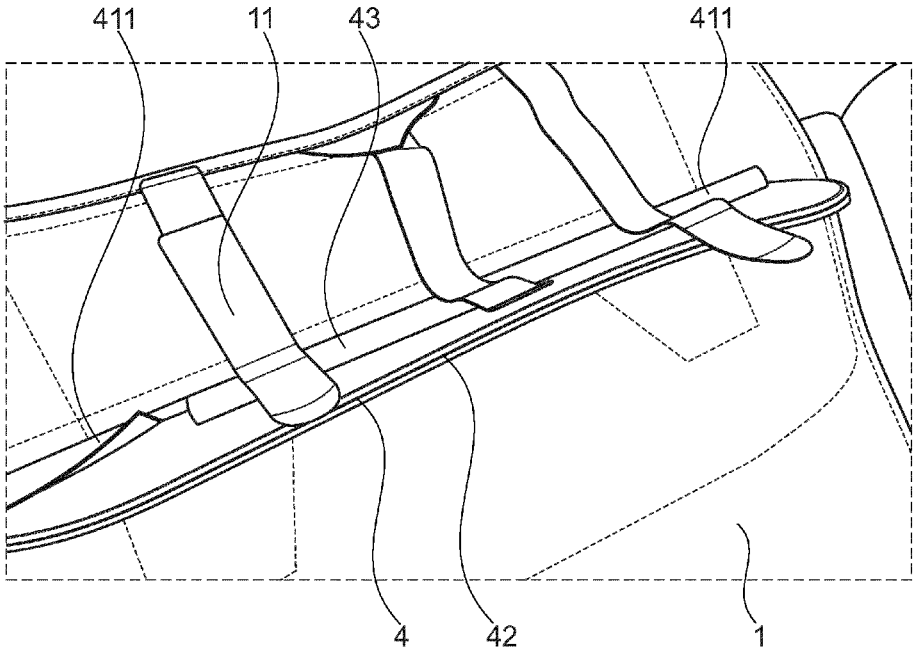
FIG. 9 shows a further exemplary embodiment of a side part on which a pocket is fastened, wherein the pocket is fastened in a pivotable manner on the side part.

A further exemplary embodiment of a side part 1 with a pocket 4 is illustrated in FIG. 9. This exemplary embodiment is distinguished in that the pocket 4 is double-layered and is fastened in a movable manner on the side part 1. As a result, it can project from the side part 1—in dependence on possible oblique positioning of the saddle panel. Thus, FIG. 9 shows a state in which the pocket 4 has been angled by almost 90° away from the side part 1.

For fastening on the side part 1, provision is made for merely an upper edge 411 of the pocket 4 to be fixed, for example sewn, to the side part 1. The upper edge 411 here is essentially rectilinear, and this provides for pivoting capability around the upper edge 411. Together with the edge 411, an edge of the other material layer, said edge being parallel to the edge 411 but not being visible in the illustration from FIG. 9, forms the opening of the pocket. The two layers of the pocket 4 are sewn to one another along the lower edge 42, and therefore the pocket 4 is closed along the lower edge 42.

As is also the case with the other exemplary embodiments, a fastening strip 43 for fastening straps 11 is provided on the upper side of the pocket 4.

Figure 10:
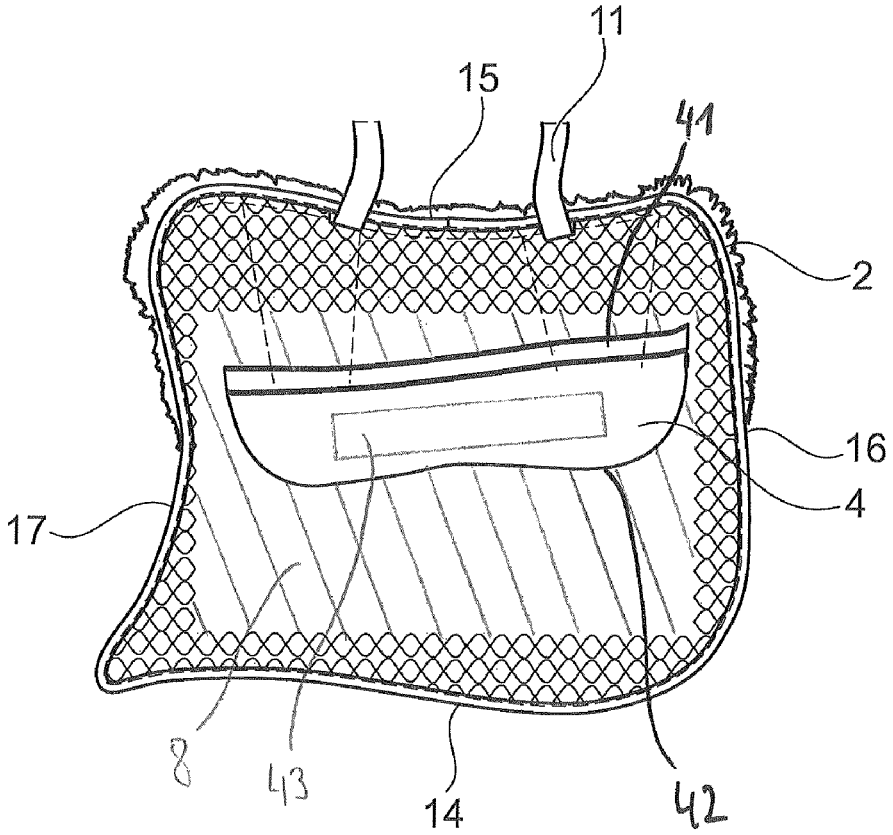
FIG. 10 shows a further exemplary embodiment of a side part on which a pocket is fastened, wherein the pocket is designed such that it can be removed from the side part via a hook-and-loop fastening.

FIG. 10 shows an exemplary embodiment of a side part 2 in the case of which the pocket 4 can be removed from the side part 2 via a hook-and-loop fastening. In the first instance, the pocket 4 is designed as in the other figures, and has an upper edge 41, a lower edge 42 and a fastening strip 43 for the fastening straps 11. However, it is double-layered. A hook-and-loop-fastener surface 8 is formed over a large surface area of the side part 2. The underside of the double-layered pocket 4 said underside not being visible in FIG. 10 is fastened on this hook-and-loop-fastener surface 8 via a hook-and-loop-fastener strip. This makes it possible for the pocket 4 to be fitted in a flexible manner at any desired location of the hook-and-loop-fastener surface 8 and to be displaced upward, downward, to the right or to the left for example in dependence on the size and position of the saddle panels.

Provision can be made here for a wide hook-and-loop-fastener strip to be fastened on the rear side of the pocket 4, in which case the pocket 4 as a whole is fastened firmly on the side part 2. As an alternative, provision can be made for the rear side of the pocket 4 to be provided with a hook-and-loop-fastener strip for example only in the region of the upper edge 41, in which case the pocket 4, connected to the side part 2 via a hook-and-loop fastening, is additionally pivotable, just as in FIG. 9.

In further exemplary embodiments, rather than the saddle panel, it is the saddle flap or—if present—the sweat flap, which is arranged between the saddle flap and saddle panel, which is arranged at least to some extent in the pocket. What has been said above in relation to arranging the saddle panel in the pocket applies correspondingly to configurations in which the saddle flap or the sweat flap is arranged in the pocket.

Of course, the invention is not restricted to the embodiments described above and it is possible to undertake various modifications and improvements without departing from the concepts described here. It is also pointed out that any of the features described can be used separately or in combination with any other features, provided they are not mutually exclusive. The disclosure extends to all combinations and sub-combinations of one or more features which are described here, and covers the same. If any ranges are defined, then they cover all the values within these ranges as well as all the sub-ranges which come within a particular range.

The invention claimed is:

1. A saddle pad for a horse, comprising:

at least one side part, which is provided and designed to extend on one side of a horse's back, the side part having an upper side, wherein the side part is provided and designed to be connected to a saddle having:

two saddle panels, two saddle flaps, optionally two sweat flaps, which are arranged in each case between the saddle panel and saddle flap, wherein the saddle panels are arranged in each case beneath the saddle flap and are provided to be laid on the horse's back, wherein the side part comprises at least one pocket on the upper side, which pocket is provided and designed to accommodate, at least to some extent, one of the panels of the saddle or a portion of the saddle panel or to accommodate, at least to some extent, one of the saddle flaps or one of the sweat flaps or a portion of the saddle flap or sweat flap, wherein the pocket is connected in a pivotable manner to the upper side of the side part.

2. The saddle pad as claimed in claim 1, wherein the side part has fastening means for fastening on a saddle.

3. The saddle pad as claimed in claim 1, wherein the pocket is connected to the upper side of the side part exclusively along an upper edge of the pocket.

4. A saddle pad for a horse, comprising:

at least one side part, which is provided and designed to extend on one side of a horse's back, the side part having an upper side, wherein the side part is provided and designed to be connected to a saddle having:

two saddle panels, two saddle flaps, optionally two sweat flaps, which are arranged in each case between the saddle panel and saddle flap, wherein the saddle panels are arranged in each case beneath the saddle flap and are provided to be laid on the horse's back, wherein the side part comprises at least one pocket on the upper side, which pocket is provided and designed to accommodate, at least to some extent, one of the panels of the saddle or a portion of the saddle panel or to accommodate, at least to some extent, one of the saddle flaps or one of the sweat flaps or a portion of the saddle flap or sweat flap, wherein the pocket is designed such that it can be removed from the upper side of the side part, wherein, on the rear side, the pocket has a hook-and-loop-fastening strip, which can be connected to a hook-and-loop-fastening surface on the upper side of the side part to form a hook-and-loop fastening.

5. The saddle pad as claimed in claim 4, wherein on the upper side of the side part, a large-surface-area hook-and-loop-fastening surface is formed, which is larger than the surface area taken up by the hook-and-loop-fastening strip, wherein the pocket can be connected to the upper side of the side part at different locations of the hook-and-loop-fastening surface to form a hook-and-loop fastening.

6. The saddle pad as claimed in claim 1, wherein the pocket is elongate and is designed to accommodate the lower portion of the saddle panel or saddle flap or sweat flap.

7. The saddle pad as claimed in claim 1, wherein the side part has a plurality of pockets, which are designed to accommodate in each case one portion of the saddle panel, wherein these portions of the saddle panel are separated spatially from one another.

8. The saddle pad as claimed in claim 2, wherein the fastening means, for connecting the side part of the saddle pad to a saddle, comprise at least two straps, which are fixed to upper edge of the side part and can be connected in a releasable manner to the pocket or some other portion of the side part.

9. The saddle pad as claimed in claim 2, wherein the fastening means, for connecting a side part of the saddle pad to a saddle, comprise a tab, which is fixed to the upper edge of the side part and can be connected in a releasable manner to the pocket or some other portion of the side part.

10. The saddle pad as claimed in claim 2, wherein the fastening means can be connected to the upper surface of the pocket or some other portion of the side part via a hook-and-loop connection.

11. The saddle pad as claimed in claim 1, wherein, at least in some regions, the side parts have an upper layer and a lower layer, between which are formed one or more chambers, into which correction pads can be introduced in each case.

12. The saddle pad as claimed in claim 11, wherein the chambers can be filled with at least one correction pad from the side edge and/or from the underside of the side part.

13. The saddle pad as claimed in claim 11, wherein the side parts have at least one chamber which is formed in the region of the front edge or rear edge of the side part.

14. The saddle pad as claimed in claim 1, wherein the underside of the saddle pad is provided at least to some extent with a fleece.

15. The saddle pad as claimed in claim 1, wherein the saddle pad has two side parts, wherein a first side part is provided and designed to extend on the one side of a horse's back, and a second side part is provided and designed to extend on the other side of the horse's back.

16. A saddle pad for a horse, comprising:

a first side part, which is provided and designed to extend on the one side of a horse's back, a second side part, which is provided and designed to extend on the other side of a horse's back, wherein the saddle pad is provided and designed to be connected to a saddle having:

two saddle panels, two saddle flaps, optionally two sweat flaps, which are arranged in each case between the saddle panel and saddle flap, wherein the saddle panels are arranged in each case beneath the saddle flap and are provided to be laid on the horse's back, wherein the two side parts are formed separately from one another and each have fastening means for fastening on a saddle, and, on a respective upper side of the two side parts, each side part of the saddle pad comprises at least one pocket, which is provided and designed to accommodate, at least to some extent, a panel of the saddle or a portion of the saddle panel or to accommodate, at least to some extent, one of the saddle flaps or one of the sweat flaps or a portion of the saddle flap or sweat flap, wherein each pocket is connected in a pivotable manner to the upper side of the respective side part and/or each pocket is designed such that it can be removed from the upper side of the respective side part, wherein, on the rear side, the pocket has a hook-and-loop-fastening strip, which can be connected to a hook-and-loop-fastening surface on the upper side of the respective side part to form a hook-and-loop-fastening.

17. The saddle pad as claimed in claim 1, wherein the side part comprises an upper edge and a lower edge, wherein the pocket ends at a distance to the lower edge of the side part.

18. The saddle pad as claimed in claim 4, wherein the side part comprises an upper edge and a lower edge, wherein the pocket ends at a distance to the lower edge of the side part.

19. The saddle pad as claimed in claim 16, wherein the side part comprises an upper edge and a lower edge, wherein the pocket ends at a distance to the lower edge of the side part.

* * * * *